US005805044A

United States Patent [19]

Leupold

[11] Patent Number: 5,805,044

[45] Date of Patent: Sep. 8, 1998

[54] FIELD FREE CHAMBER IN PERMANENT MAGNET SOLENOIDS

[75] Inventor: Herbert A. Leupold, Eatontown, N.J.

[73] Assignee: The United States of America as represented by the Secretary of the Army, Washington, D.C.

[21] Appl. No.: 198,074

[22] Filed: Feb. 15, 1994

[51] Int. Cl.[6] ..... H01F 7/02; H01J 23/02

[52] U.S. Cl. ..... 335/306; 335/210; 335/297; 315/5.35; 315/5

[58] Field of Search ..... 335/297, 298, 335/302, 306, 210, 212; 315/5.34, 5.35, 4, 5; 372/2

[56] References Cited

U.S. PATENT DOCUMENTS

| | | | |
|---|---|---|---|
| 3,768,054 | 10/1973 | Neugebauer . | |
| 3,896,329 | 7/1975 | Lien | 315/3.5 |
| 4,647,887 | 3/1987 | Leupold . | |
| 4,654,618 | 3/1987 | Leupold | 335/304 |
| 4,692,732 | 9/1987 | Leopold | 335/302 |
| 4,701,737 | 10/1987 | Leupold | 335/301 |
| 4,953,555 | 9/1990 | Leupold | 128/653 A |
| 5,028,902 | 7/1991 | Leupold | 335/306 |
| 5,084,690 | 1/1992 | Leupold | 335/306 |
| 5,126,713 | 6/1992 | Leupold . | |

OTHER PUBLICATIONS

Leupold et al, "A Catalogue of Novel Permanent–Magnet Field Sources,", Paper No. W3.2, 9th International Workshop on Rare Earth Magnets and Their Applications, pp. 109–123, Aug. 1987, Bad Soden, FRG.

Leupold et al, "Novel High–Field Permanent–Magnet Flux SSources", IEEE Transactions on Magnetics, vol. MAG–23, No. 5, pp. 3628–3629, Sep. 1987.

*Primary Examiner*—Leo P. Picard
*Assistant Examiner*—Jayprakash N. Gandhi
*Attorney, Agent, or Firm*—Michael Zelenka; William H. Anderson

[57] ABSTRACT

A low-loss magnetic structure that provides an electron beam focusing field that can be accessed without field reversal. More specifically, the structure provides a uniform magnetic field that can be accessed from an adjacent field-free chamber within which an electron beam source of any size can be housed. The field-free chamber is separated from uniform field by a passive ferromagnet having a hole through which the electron beam can pass. The passive ferromagnet is instrumental in preventing the uniform field from entering the field-free chamber.

5 Claims, 2 Drawing Sheets

FIG. 1
(PRIOR ART)
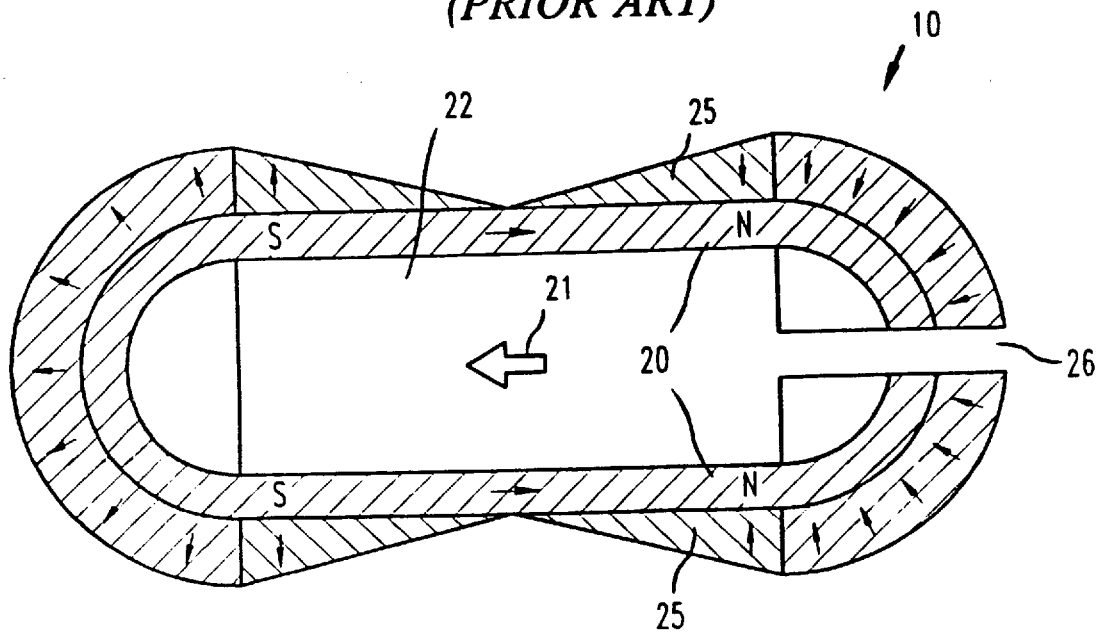
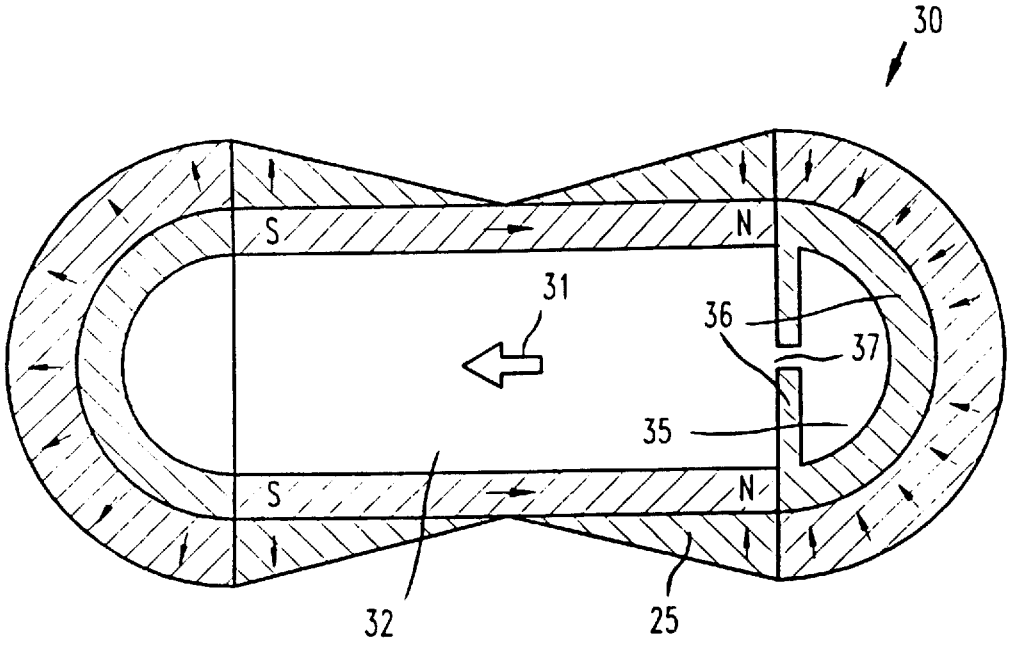
FIG. 2

FIG. 3
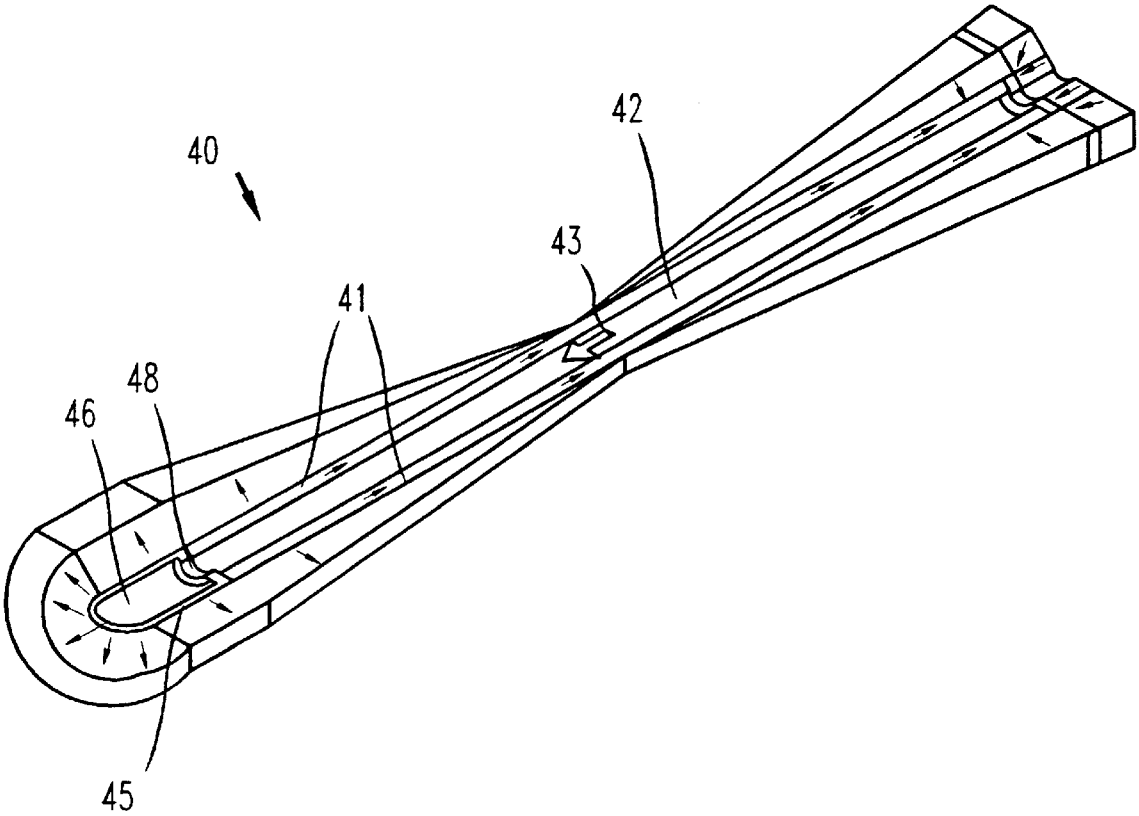
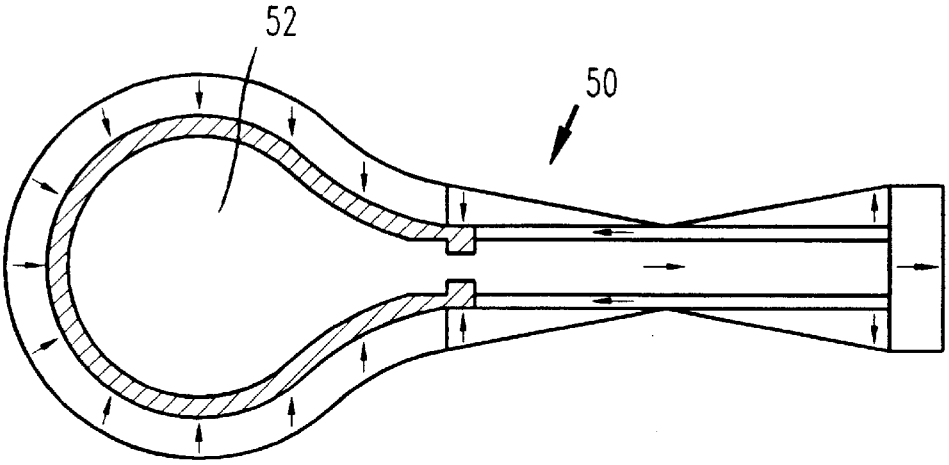
FIG. 4

FIELD FREE CHAMBER IN PERMANENT MAGNET SOLENOIDS

GOVERNMENT INTEREST

The invention described herein may be manufactured, used and licensed by or for the Government for governmental purposes without the payment to me of any royalties thereon or therefor.

BACKGROUND OF THE INVENTION

This invention relates generally to the field of magnetic devices and more particularly to low leakage magnetic structures that provide a high internal electron beam focusing field.

Presently, there are various magnetic structures that generate an internal magnetic field for electron-beam focusing. See, Leupold et al., "A Catalogue of Novel Permanent-Magnet Field Sources," Paper No. W3.2, 9th International Workshop on Rare Earth Magnets and Their Applications, pp. 109–123, August 1987, Bad Soden, FRG. See also, Leupold et al., "Novel High-Field Permanent-Magnet Flux Sources," IEEE Transactions on Magnetics, vol. MAG-23, No. 5, pp. 3628–3629, September 1987.

Some of these structures have been magnetically cladded to reduce the leakage of their internal magnetic field into the environment. See, generally, U.S. Pat. No. 5,126,713, entitled, "Hemispherical Cladding for Permanent Magnet Solenoids," issued to H. A. Leupold. As a result, the cladding also enhanced the strength and quality of the structure's internal magnetic field. Such structures have been utilized in devices including klystrons, traveling wave tubes, and nuclear magnetic resonance imaging systems.

Two examples of such structures are found in the teachings of U.S. Pat. No. 3,768,054, entitled, "Low Flux Leakage Magnetic Construction" issued to Wendell Neugebauer, on Oct. 23, 1973, and U.S. Pat. No. 4,647,887, entitled, "Lightweight Cladding For Magnetic Circuits", issued to H. A. Leupold, the present inventor, on Mar. 3, 1987. In both of these structures, a permanent magnet was placed external to a magnetic flux source to clad the flux source's outer shell, and thus prevent leakage of the internal field produced by that flux source.

More specifically, the external permanent cladding magnet was placed adjacent to the exterior of a permanent magnet flux source having an internal chamber containing a uniform magnetic field. The cladding magnet was magnetized in a direction perpendicular to that of the flux source's shell so that it would redirect any flux trying to escape from the internal chamber back into the chamber. As a result, the cladding magnets reduced the flux leakage, and thus increased the intensity of the internal field.

An even more efficient structure was disclosed in the teachings of U.S. Pat. No. 5,126,713, entitled, "Hemispherical Cladding for Permanent Magnet Solenoids," also issued to H. A. Leupold. This patent disclosed the use of additional cladding magnets (over the then existing prior art) to further reduce the flux escaping from the sharp corners of such structures. Specifically, hemispherical-shaped permanent magnet cladding elements were placed adjacent to the corners of these structures so that the each end of the structure was smoothed out. This additional cladding proved to significantly reduce the internal flux leakage over those existing structures.

Although structures that provide a uniform internal magnetic field are useful for focusing electron beams, the above devices are not desirable for such applications. More specifically, because these structures require that the electron beam be injected into the chamber containing the focusing field from the exterior of the structure, they expose the electron beam to a field reversal. As the electron beam passes through the field source's shell, it experiences a field in one direction, but when it enters the internal chamber it experiences the focusing field in the opposite direction. This complicates the dynamics of the electron beam and hampers the overall control of the application.

Moreover, such devices pose a problem for those electron beam sources that can not operate in the presence of a magnetic field. In such situations, the competing interest of a field-free environment for the electron beam source conflicts with the need for a focusing field for the electron beam to prevent beam dissipation. Consequently, the transition from zero magnetic field to full field must be as abrupt as possible.

For these reasons, those skilled in the art greatly desire a device having an internal electron-beam-focusing magnetic field in close proximity to field-free chamber, within which an electron beam source can be housed, so that an electron beam can be projected into the magnetic field without experiencing a field reversal and without having time to dissipate.

SUMMARY

Accordingly, it is an object of this invention to provide a low leakage permanent magnet structure having an internal chamber with a uniform magnetic field for electron beam focusing, and an adjacent field-free chamber within which an electron beam source may be placed such that an electron beam can be injected into the internal chamber from the field-free chamber without experiencing a field reversal.

It is yet another object of the invention to provide the structure described above wherein the field-free chamber can be enlarged to provide enough space for any size electron beam source.

Briefly, the foregoing and other objects of the invention are achieved by fixing a passive ferromagnet, such as permalloy or iron, at a predetermined end of the internal chamber to create an adjacent field-free chamber having an access port leading to the internal chamber for electron beam passage thereto. The term 'passive' is used to indicate the known ability of a ferromagnet to become magnetized upon the application of an external magnetic field. Thus, in structures as discussed above, a passive ferromagnet is simply a ferromagnetic material that can become magnetized by the permanent magnets that form the internal chamber containing the uniform magnetic field.

BRIEF DESCRIPTION OF THE DRAWINGS

FIG. 1 is a longitudinal cross section of a known prior art cladded permanent magnet solenoid.

FIG. 2 is a crossectional view of a preferred embodiment showing the field free chamber defined by the passive ferromagnets placed at a predetermined end.

FIG. 3 is a crossectional view of another embodiment of the invention, showing the passive ferromagnetic defining the field free chamber at a predetermined end.

FIG. 4 is a crossectional view of the embodiment in FIG. 3 showing an enlarged field free chamber that provides space for larger electron beam sources.

DETAILED DESCRIPTION OF THE INVENTION

Referring now to the drawings and more particularly to FIG. 1, there is shown prior art, cladded permanent magnet solenoid 10 having flux source 20 producing uniform flux 21 within internal chamber 22. Cladding permanent magnets 25 surround flux source 20 and are magnetized such that they redirect any flux 21 trying to escape back into chamber 22. This not only reduces flux 21 leakage into the environment, it also increases the intensity of the internal field.

Flux 21 of prior art structure 10, however, is not useful for focusing electron beams. To utilize structure 10 for such an application, the electron beam must be injected from the exterior of structure 10 through access port 26. This would expose the electron beam to a field reversal as it passes through access port 26 into chamber 22. Such a field reversal complicates the dynamics of the electron beam and hampers the overall control of the application.

A solution to the problem is illustrated in FIG. 2. Referring to FIG. 2, there is shown preferred embodiment 30 having internal chamber 32 in which there is a uniform magnetic field 31. Adjacent said internal chamber is field-free chamber 35 formed by passive ferromagnet 36. Passive ferromagnet 36 also forms the barrier between field-free chamber 35 and internal chamber 32, in which there is tunnel 37 through which an electron beam may readily pass from field-free chamber 35 to internal chamber 32 for focusing. Consequently, an electron beam source may be placed within field-free chamber 35 so that an electron beam may be injected into internal chamber 32 without experiencing a field reversal. To illustrate, as the electron beam passes from field-free chamber 35 to internal chamber 32, it experiences no field from passive ferromagnet 36, whereas when it enters internal chamber 32, it only experiences focusing field 31.

Another embodiment of the invention, having a shape and size that is substantially different from structure 30 is shown in FIG. 3. Referring now to FIG. 3 there is shown structure 40 having cylindrical flux source 41 with internal chamber 42. Internal chamber 42 contains uniform magnetic field 43 pointing in a predetermined direction. Passive ferromagnet 45, which has a substantially tubular body with a substantially hemispherical head is placed adjacent to a predetermined end of internal chamber 42. Passive ferromagnet 45 defines a field-free chamber 46 from which an electron beam may be injected into internal chamber 42 through tunnel 48 without experiencing a field reversal. As a result, the problems associated with such field reversals, described above, are eliminated.

Although passive ferromagnet 45 of structure 40 differs in shape from that of passive ferromagnet 36 of structure 30 (in FIG. 2), the effect of each passive ferromagnet on its respective structure is the same. Each passive ferromagnet creates a field free chamber adjacent to its respective internal chamber so that an electron beam can be injected therein without experiencing a field reversal.

Referring now to FIG. 4, there is shown structure 50 having an embodiment similar to that of structure 40. The major difference is that structure 50 has a field-free chamber 52 that is basically an enlarged version of field-free chamber 46 of structure 40 in FIG. 3. This enables field-free chamber 52 to accommodate a much larger electron beam source. Essentially, structure 50 illustrates that the field-free chamber of such structures can be enlarged to accommodate any size electron beam source therein.

In light of the above teachings many other variations and modifications of the present invention are possible. For example, the inventive technique may be applied to a variety of other magnetic flux sources of different shapes and sizes. Further, the inventive technique can utilize a variety of passive magnetic material to form field-free chambers of various sizes and shapes, and placed in various locations adjacent to the internal chamber containing the flux source. It is therefore understood that within the scope of the applied claims, the invention may be practiced otherwise than specifically described.

What is claimed is:

1. A low-leakage magnetic structure, comprising:

a permanent magnet flux source having at least two ends and an internal chamber, said internal chamber containing a uniform magnetic field pointing in a predetermined direction; and a passive ferromagnet adjacent to a predetermined end of said flux source, said passive ferromagnet forming a field-free chamber having a predetermined size and shape defined by said passive ferromagnet, said field free chamber communicating with said internal chamber of said flux source such that an electron beam can pass from said field-free chamber into said internal chamber without experiencing a field reversal.

2. The magnetic structure of claim 1 wherein said permanent magnet flux source is surrounded by cladding magnets, said cladding magnets having radial magnetization with respect to said internal chamber and a predetermined shape such that all points on the surface of said magnetic structure have the same magnetic potential, said cladding magnets acting to confine said internal magnetic field to said internal chamber.

3. The magnetic structure of claim 1 wherein said field free chamber is comprised of a hollow iron hemisphere surrounded by cladding magnets having a predetermined size and magnetization so that said adjacent magnetic field in said adjacent internal chamber is maintained.

4. The magnetic structure of claim 1 wherein said field-free chamber is a cylindrical space.

5. The magnetic structure of claim 1 wherein said field-free chamber is a hemispherical space.

* * * * *